US005647767A

United States Patent [19]

Scheer et al.

[11] Patent Number: 5,647,767

[45] Date of Patent: Jul. 15, 1997

[54] ELECTRICAL CONNECTOR JACK ASSEMBLY FOR SIGNAL TRANSMISSION

[75] Inventors: Peter L. Scheer, Camp Hill, Pa.; Venkat A. Raman, Santa Clara, Calif.; Steven E. Minich, Carlisle, Pa.

[73] Assignee: The Whitaker Corporation, Wilmington, Del.

[21] Appl. No.: 591,080

[22] Filed: Jan. 25, 1996

Related U.S. Application Data

[63] Continuation-in-part of Ser. No. 550,309, Oct. 30, 1995, abandoned, which is a continuation-in-part of Ser. No. 384,085, Feb. 5, 1995, abandoned.

[51] Int. Cl.[6] ..... H01R 13/66

[52] U.S. Cl. ..... 439/620; 439/676

[58] Field of Search ..... 439/620, 676

[56] References Cited

U.S. PATENT DOCUMENTS

| | | | |
|---|---|---|---|
| 3,850,497 | 11/1974 | Krumreich et al. | 339/126 R |
| 4,047,242 | 9/1977 | Jakob et al. | 361/389 |
| 4,193,654 | 3/1980 | Hughes et al. | 339/17 LC |
| 4,202,593 | 5/1980 | Abernethy et al. | 339/125 R |
| 4,261,633 | 4/1981 | Abernethy | 339/97 P |
| 4,274,691 | 6/1981 | Abernethy et al. | 339/19 |
| 4,329,665 | 5/1982 | Kawai et al. | 333/182 |
| 4,600,256 | 7/1986 | Anttila | 339/17 M |
| 4,602,122 | 7/1986 | Lint | 174/52 R |
| 4,618,207 | 10/1986 | Silbernagel | 339/176 M |
| 4,695,115 | 9/1987 | Talend | 439/76 |
| 4,698,025 | 10/1987 | Silbernagel et al. | 439/79 |
| 4,699,595 | 10/1987 | Nakazawa et al. | 439/676 |
| 4,703,991 | 11/1987 | Philippson | 439/676 |
| 4,720,155 | 1/1988 | Schildkraut et al. | 439/108 |
| 4,726,638 | 2/1988 | Farrar et al. | 439/608 |
| 4,726,790 | 2/1988 | Hadjis | 439/620 |
| 4,729,752 | 3/1988 | Dawson, Jr. et al. | 439/620 |
| 4,758,921 | 7/1988 | Hung | 361/119 |
| 4,772,224 | 9/1988 | Talend | 439/607 |
| 4,782,310 | 11/1988 | Saburi et al. | 333/167 |
| 4,786,259 | 11/1988 | Paul | 439/344 |
| 4,789,847 | 12/1988 | Sakamoto et al. | 333/185 |
| 4,799,901 | 1/1989 | Pirc | 439/620 |

(List continued on next page.)

FOREIGN PATENT DOCUMENTS

| | | |
|---|---|---|
| 0262339 | 6/1988 | European Pat. Off. . |
| 2169157 | 7/1986 | United Kingdom . |

OTHER PUBLICATIONS

AMP Customer Drawing 555694 dated May 31, 1991.
AMP Customer Drawing 557573 dated Jun. 15, 1992.
AMP Customer Drawing 554269 dated Feb. 2, 1984.
AMP Customer Drawing 557562 dated Jun. 8, 1992.
AMP Standard Products Catalog p. 737, 4th Ed. Issued Mar. 1985.

*Primary Examiner*—Gary F. Paumen

[57] ABSTRACT

A modular jack electrical connector assembly 2 suitable for conditioning the signals in unshielded twisted pair wires for use with network components is disclosed. The modular jack 2 comprises a conventional insulative housing 4 and an insert subassembly 6 including an insert molded front insert member 8 and a rear insert member 10. Contact terminals 12 for mating with a modular plug extend from the front insert member 8 and into the rear insert member 10. The rear insert member 10 also includes signal conditioning components such as common mode choke coils 38, filter circuits 40 and transformers 54 suitable for conditioning the twisted pair signals for used in applications such as for input to and output from IEEE 10 Base-T network components. The rear insert member includes an insert molded body 30 which stabilizes the position of the contact terminals 12 and leads 14 extending from the rear insert member 10 for attachment to external circuits, such as the external printed circuit board containing the interface processor for the specific application. The signal conditioning components can be mounted on a component printed circuit board 36 also encapsulated. Additional leads 50, 60, 70, 80 are connected to an exposed portion of the component printed circuit board to serve as ground and other connections. A shield 92 can also establish contact with the exposed portion of the component printed circuit board to establish a ground connection.

25 Claims, 9 Drawing Sheets

U.S. PATENT DOCUMENTS

| | | | |
|---|---|---|---|
| 4,804,332 | 2/1989 | Pirc | 439/620 |
| 4,878,848 | 11/1989 | Ingalsbe | 439/76 |
| 4,930,200 | 6/1990 | Brush, Jr. et al. | 29/25.42 |
| 4,937,464 | 6/1990 | Nanba et al. | 307/112 |
| 4,950,169 | 8/1990 | Martin et al. | 439/44 |
| 5,015,204 | 5/1991 | Sakamoto et al. | 439/620 |
| 5,069,641 | 12/1991 | Sakamoto et al. | 439/620 |
| 5,078,609 | 1/1992 | Bouchan et al. | 439/43 |
| 5,139,442 | 8/1992 | Sakamoto et al. | 439/620 |
| 5,178,563 | 1/1993 | Reed | 439/676 |
| 5,240,436 | 8/1993 | Bradley et al. | 439/654 |
| 5,254,973 | 10/1993 | Gilmore, II | 340/547 |
| 5,260,994 | 11/1993 | Suffi | 379/399 |
| 5,362,257 | 11/1994 | Neal et al. | 439/676 |

ELECTRICAL CONNECTOR JACK ASSEMBLY FOR SIGNAL TRANSMISSION

This application is a continuation-in-part of U.S. patent application Ser. No. 08/550,309 filed Oct. 30, 1995, now abandoned, and is hereby incorporated by reference, which is a continuation-in-part of U.S. patent application Ser. No. 08/384,085 filed Feb. 5, 1995, now abandoned, hereby incorporated by reference.

FIELD OF THE INVENTION

This invention relates to electrical connectors, such as modular jack assemblies used with twisted pair cable in telecommunications and networking applications. Furthermore, this invention is related to modular jack assemblies which include signal conditioning subassemblies for eliminating undesirable extraneous signals, such as high frequency noise, common mode noise and dc voltage from twisted pair lines before output by the modular jack assembly.

BACKGROUND OF THE INVENTION

Twisted pair wires are simple and inexpensive and therefore perhaps the most commonly used type of cable for low voltage signal transmission. The most common use of twisted pair wires is in telephone circuits. Unused twisted pair telephone cable currently installed in buildings is however often adequate for applications other than telephone circuits, such as for local area networks. For example, IEEE 802.3 10 Base T (Twisted Pair Ethernet) local area networks and 4 and 16 Mbps token ring local area networks can use unshielded twisted pair cable. For new installations, unshielded twisted pair cable is less expensive than coaxial cable or shielded twisted pair cable. Technicians also have significant twisted pair installation experience.

Use of twisted pair cable for many network applications requires signal conditioning or noise suppression. Common mode chokes, isolation transformers and filters, or some combination of one or more of these three, are often necessary. Chokes provide common mode rejection and impedance matching. The transformers provide dc isolation. LC filters can be used to filter out high frequency noise. Typically, these signal or line conditioning components and simple circuits are located on the network node or hub board to which the twisted pair cable is attached. Some form of standard modular jack or modular telephone jack is used to connect the cable to the node or hub printed circuit board. One specified interconnection for 10 Base T networks, or the medium dependent interface connector, is an eight position modular jack, which is referred to as a RJ-45 jack. These signal conditioning or noise suppression components are conventionally located on the printed circuit board between the connector and the processor used in the hub, medium attachment unit, transceiver circuit, multiport repeater, node or other network unit. Transmit and receive lines can each require signal conditioning. A large number of processors are available for such applications. For example, the Intel 82504 can be used in the analog front end of a 10 Base T node. These signal conditioning components can be discretely mounted on printed circuit boards or they can be manufactured as a separate subassembly which can then be mounted on a printed circuit board. These separate subassemblies can include chokes, chokes plus transformers, or they can be choke, transformer, filter subassemblies.

Although existing local area networks can require this type of signal conditioning or noise suppression, some form of signal conditioning is often necessary for other applications. For example, telephone circuits can require common mode chokes. For higher performance systems currently under consideration, such as 100 mbps local area networks, even more sophisticated signal conditioning or noise suppression will be necessary.

There have been a number of prior art electrical connectors which have incorporated the connector and a filtering circuit into one subassembly. U.S. Pat. No. 4,726,638 is one example of a modular telephone jack with discrete diodes between each lead and ground. These diodes are mounted on a small printed circuit board. A slot on the back of the modular telephone jack housing receives the printed circuit board, which is positioned parallel to the bottom of the telephone jack. Each telephone jack lead is soldered to the printed circuit board at the rear. The diodes are mounted between each lead and ground and not between the ends of the lead, so it is not necessary to separate the lead when it is soldered to the printed circuit board.

A subassembly of an electrical connector and a signal conditioning circuit offers several advantages. Printed circuit board real estate on the main hub or node board is conserved because additional circuitry is now located within the connector foot print or in a space less than the sum of the space otherwise occupied by the connector and separate signal conditioning circuitry. Final assembly of the main printed circuit board requires fewer components. The printed circuit board conductors are also shorter and should therefore be less susceptible to external noise.

The connector subassembly of U.S. Pat. No. 4,726,638 includes, however, a relatively simple noise suppression circuit. For applications such as local area networks, multiple components are needed on multiple lines. The size of the substrate on which these multiple components are mounted must remain relatively small, if all of the advantages of this subassembly are retained. Mutual interference between signal conditioning components may also be a problem and the placement of the various electronic components can be quite critical. Placement is a problem, even for prior art devices in which the signal conditioning components are placed on the printed circuit board. In order to maintain proper component placement in such assemblies, it is common practice to mechanically fix components in place. These components can be mechanically fixed in place by potting the components with an epoxy, or other bonding agent, or by insert molding a number of components in a physical subassembly.

Insert molding is used in other applications to retain electrical elements in position. For example, U.S. Pat. No. 5,362,257 discloses an eight conductor modular jack assembly in which crossing leads are maintained in position by insert molding plastic around the leads. Insert molding is also used to encapsulate many standard integrated circuit components. The modular jack disclosed in U.S. Pat. No. 5,362,257 also comprises an easily assembled two component assembly in which an insert molded lead subassembly is mated with a separate housing assembly.

Other modular jack subassemblies incorporating chokes in a telephone jack housing are shown in U.S. Pat. No. 5,015,204 and U.S. Pat. No. 5,069,641. U.S. Pat. No. 5,015,204 discloses a modular jack assembly in which jack leads are wound around a choke coil. U.S. Pat. No. 5,069,641 discloses a modification of this other patent in which the choke coil and lead segments are soldered to a printed circuit board. This printed circuit board assembly is then encased in an insulating housing consisting of a base and a lid and having two internal chambers. The choke coil printed circuit board is mounted in one chamber which is separated by a separator from a chamber adapted to receive a modular plug. This latter device is assembled by inserting the choke coil printed circuit board subassembly in the housing and inserting the terminal leads through the bottom of the housing base. The contactor on the opposite end extends over the separator into the plug receiving chamber. A lid is then attached to encase the choke coil printed circuit board subassembly. Although this patent depicts only the use of a choke coil, it does suggest that chip inductors and chip capacitors, etc. could also be used. Although not addressed in U.S. Pat. No. 5,069,641, adaptation of that approach to 10 Base T and Token Ring applications would in all likelihood require encapsulation of the components by insert molding or potting them prior to assembly in the housing, or by potting the printed circuit board subassembly after insertion in the housing chamber.

None of these prior art devices depict a modular jack assembly suitable for use in a broad range of network applications and suitable for use at frequencies such as those encountered in 10 Base T, token ring, or networks having even higher data rates, such as proposed 100 Mhtz. networks. None of these devices show a network jack assembly in which chokes, chokes and transformers, or choke, transformer, filter combinations can be positioned in series with multiple leads in a modular jack. None of these devices depict a network jack assembly in which each of these multiple components can be precisely positioned and in which that precise positioning can be maintained over the life of the device to insure that consistent electrical performance can be achieved among multiple devices and over the life of a single device. None of these devices show a modular jack assembly in which the electronic components can be protected. None of these devices disclose a modular jack assembly which can be fabricated by positioning the components on a small printed circuit board, insert molding leads to be connected to this printed circuit board and then mating this subassembly with a modular jack housing having a profile for receiving a modular plug. An assembly having all of these features would be more easily assembled than, for example the assembly of U.S. Pat. No. 5,069,641. The insert molded subassembly would stabilize the position of the leads, which would not have to be inserted in holes in the bottom of the housing to provide sufficiently precise positioning for lead placement in printed circuit board plated through holes or on surface mount pads.

A signal transmission jack which addresses each of these shortcomings is disclosed in a co-pending application entitled Electrical Connector Jack for Signal Transmission, Serial No. 08/384,086, was filed in the name of Venkat Raman on the same date as the parent application and is hereby incorporated by reference. That modular jack has the same lead footprint as a standard RJ-45 jack and used one of the eight leads in the standard footprint as a connection to ground. In that co-pending application, the printed circuit board subassembly and the leads are encapsulated, preferably by insert molding.

In some cases, it is desireable to replace the electronic components on the printed circuit board subassembly either for purposes of repair, modification, or upgrade in the circuitry connected to the modular jack. There is a need, therefore, for an upgradeable modular jack assembly.

SUMMARY OF THE INVENTION

In this invention, signal conditioning is included in a modular jack assembly which can be mounted on a network component interface card or printed circuit board. This invention conditions the signals carried by media, such as unshielded twisted pair wires, that would not otherwise be suitable for use with that network component. The modular jack assembly includes a housing having a cavity for receiving a conventional modular plug attached to the wires. In the preferred embodiments, this housing is a conventional housing suitable for use with unshielded twisted pair wires in conventional applications. An insert molded subassembly mates with the housing. This insert molded subassembly includes front and rear insert members. Contact terminals extend from the front insert member into the plug receiving cavity to mate with the modular plug. These contact terminals also extend from the front insert member into the rear insert member. Signal conditioning components, such as choke coils, transformers and LC filters can be encapsulated on a printed circuit board in the rear insert member which mates in a rear open ended channel on the modular jack housing. The rear insert member is insert molded so that molded plastic completely surrounds the portions of the contact terminals extending into the rear insert member. Leads for connecting the modular jack assembly to external circuits also extend from the rear insert member and are insert molded in the rear insert body.

For example, printed circuit board leads can extend from the rear insert member in a footprint for connection to an external printed circuit board or interface card. The signal conditioning components are soldered directly to a component printed circuit board on which the signal conditioning components have been mounted and encapsulated. The component printed circuit board subassembly is inserted into two communicating slots in the rear insert body. Contact terminal ends and lead ends engage terminal pads on opposite sides of the component printed circuit board. In addition to standard footprint leads extending from the printed circuit board subassembly to an external printed circuit board, one or more additional leads can extend from the printed circuit board for ground connections and for additional connections which may be required. These additional leads extend from a portion of the component printed circuit board which extends beyond the insert molded body of the printed circuit board subassembly. These leads can be initially mounted on either the external printed circuit board or on the component printed circuit board and soldered to the other printed circuit board when the modular jack assembly is mounted on the external printed circuit board.

BRIEF DESCRIPTION OF THE INVENTION

FIG. 3 is a view of the component printed circuit board assembly and the body of the rear insert member in which the component printed circuit board assembly is mounted.

FIG. 13 is a cross sectional view of a modular jack assembly according to the teachings of the present invention of an upgradeable modular jack assembly.

DETAILED DESCRIPTION OF THE PREFERRED EMBODIMENTS

The seven embodiments of this invention described herein represent the basic elements of this invention, which can be incorporated in other configurations not specifically shown. These representative embodiments will be described with reference to specific applications, such as IEEE 802.3 10 Base T (twisted pair Ethernet) local area networks, but these applications are similarly intended to be only representative. Other applications including but not limited to telecommunications, local area networks, such as twisted pair token ring or twisted pair FDDI, or other twisted pair applications can also employ this invention. Although typically used with twisted pair cable, modular jacks can also be used with untwisted pair conductors, and this invention could also be suitable for improving the signal transmission performance of untwisted wires. Indeed this invention would be suitable for any application in which signal conditioning is required so that the signals transmitted by the cable could be utilized by the device to which it is attached. The signal conditioning which can be implemented by this invention is primarily related to the removal of noise, but the term signal conditioning as used herein is not to be so limited. Signal conditioning can include, but is not limited to, the removal of high frequency noise, common or differential mode noise, and signal conditioning can also include impedance matching and voltage isolation, cross talk suppression, step down and step up transformers and achieving Category 5 twisted pair cable performance. This invention can also be used to permit the substitution of unshielded twisted pair for shielded twisted pair conductors for applications such as token ring networks.

Figure 1:
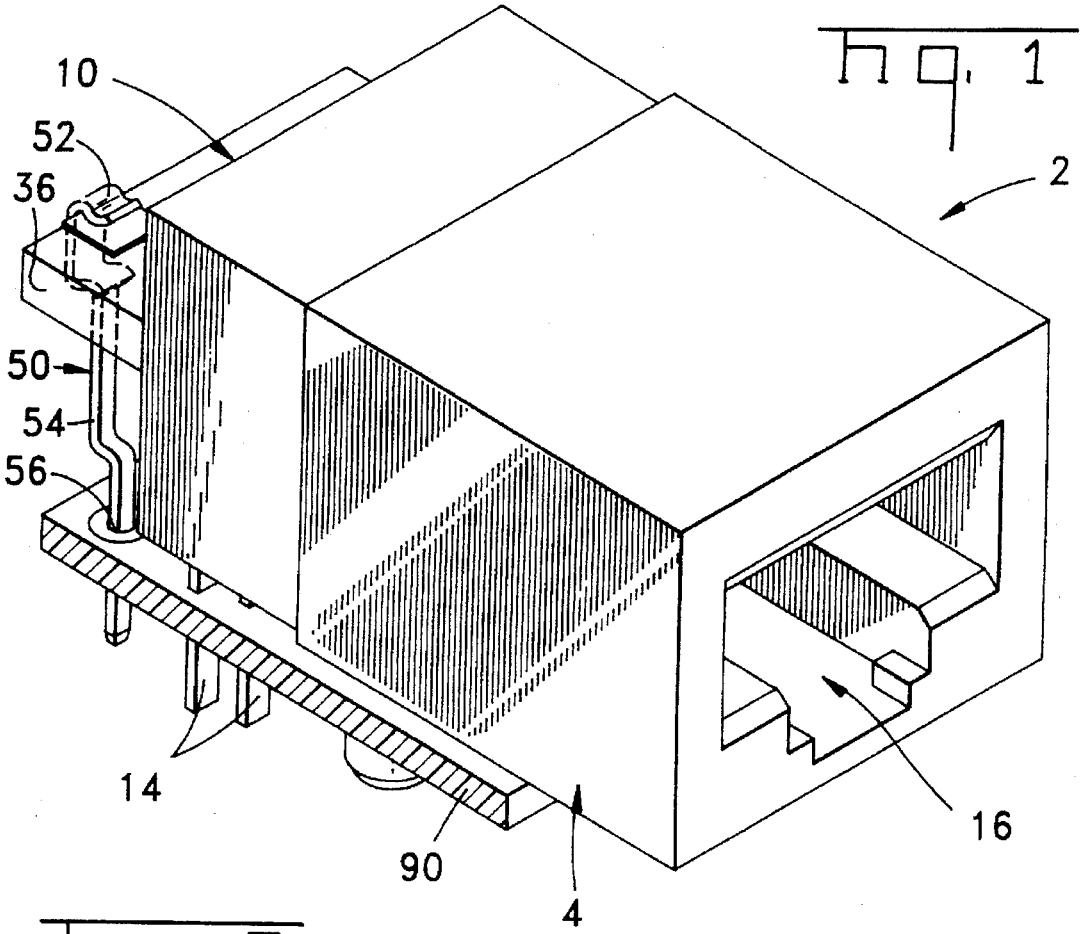
FIG. 1 is a perspective view of a first embodiment of a printed circuit board mounted modular jack electrical connector assembly, including a signal conditioning insert member.

As shown in FIG. 1 this invention takes the form of a modular jack 2. Modular jacks are a common interface for twisted wires. Although originally intended for use in telephone applications, modular jacks are now used in a number of applications, especially for twisted pair local area networks. Several different modular jack versions are available and this invention can be used with each. Six conductor or RJ-11 jacks are used in some applications and eight conductor or RJ-45 jacks are used in others, such as 10 Base T applications. This invention can be used not only with modular jack configurations, but with similar jack configurations, such as the shielded data link jack supplied by AMP Incorporated. This invention can also be used with multi-gang modular jacks in which more than one six or eight position terminal array is mounted in one or more rows of a single housing, having more than one plug mounting cavity, to integrate a plurality of modular jacks into one assembly.

The modular assemblies, shown in FIGS. 1–7 each use an eight position or RJ-45 modular jack. Each modular jack 2 comprises a housing 4 with eight leads or terminals positioned side by side on the plug mating end of the modular jack and offset in a conventional staggered footprint at the rear end where the jack is mated with the external printed circuit board on which it is mounted. The modular jack assembly in each of these representative embodiments also includes leads in addition to those included in a standard modular jack footprint.

Modular jack 2 has a conventional plug mating cavity 16 at the front end of the housing 4 and a rearwardly facing open ended channel 20 at the rear end of the housing 4. This modular jack 2 is a right angle or side entry jack in which the plug mating cavity 16 and the channel 20 extend between the upper surface of the housing 4 and a lower surface that is positioned on top of an external printed circuit board. This plug mating cavity 16 is dimensioned to receive an eight position modular plug, which is of conventional construction and is therefore not shown. The modular jack housing 4 is also of conventional construction. The same housing used for the modular jack depicted in U.S. Pat. No. 5,362,257 is also used in the modular jack 2 depicted herein. It should be noted that the same housing could also be used for a six position jack configuration. Although one of the advantages of this invention is that it can be used with a conventional housing, the invention is not limited to use with this conventional housing. For example this invention could be used with a housing in which the plug mating cavity was oriented perpendicular to the printed circuit board (a top entry configuration) instead of the right angle position (side entry configuration) of the disclosed embodiments. This invention can also be used with multi-gang modular jacks in which more than one six or eight position terminal array is mounted in one or more rows of a single housing, having more than one plug mounting cavity, to integrate a plurality of modular jacks into one assembly. An insert subassembly 6 is used to position the leads or terminals in the housing 4. The insert subassembly 6 comprises a front insert member 8 and a rear insert member 10. Contact terminals 12 are positioned in the front insert member 8 and extend into the rear insert member 10. Leads 14 extend from the opposite end of the rear insert member 10 to form an electrical interconnection with external circuits. In the preferred embodiments of this invention, these external circuits are located on an external printed circuit board 90 on which the modular jack 2 is mounted.

The contact terminals 12 and the leads 14 employed in the preferred embodiments are stamped and formed leads. These stamped and formed leads are fabricated from a conventional spring metal, such as phosphor bronze, and plated in the same conventional manner used with prior art modular jacks using stamped and formed leads. The contact terminals 12 and the leads 14 are positioned in a mold where the front insert member 8 and the rear insert member 10 are formed by insert molding plastic around the contact terminals 12 and the leads 14. As part of this insert molding operation, front insert body 34 and rear insert body 30, are simultaneously formed as part of the same operation. These bodies, which encapsulate portions of the contact terminals 12 and the leads 14, can be fabricated from a thermoplastic, suitable for injection molding. A liquid crystal polymer, such as Vectra manufactured by Hoechst Celanese can be used.

Figure 2:
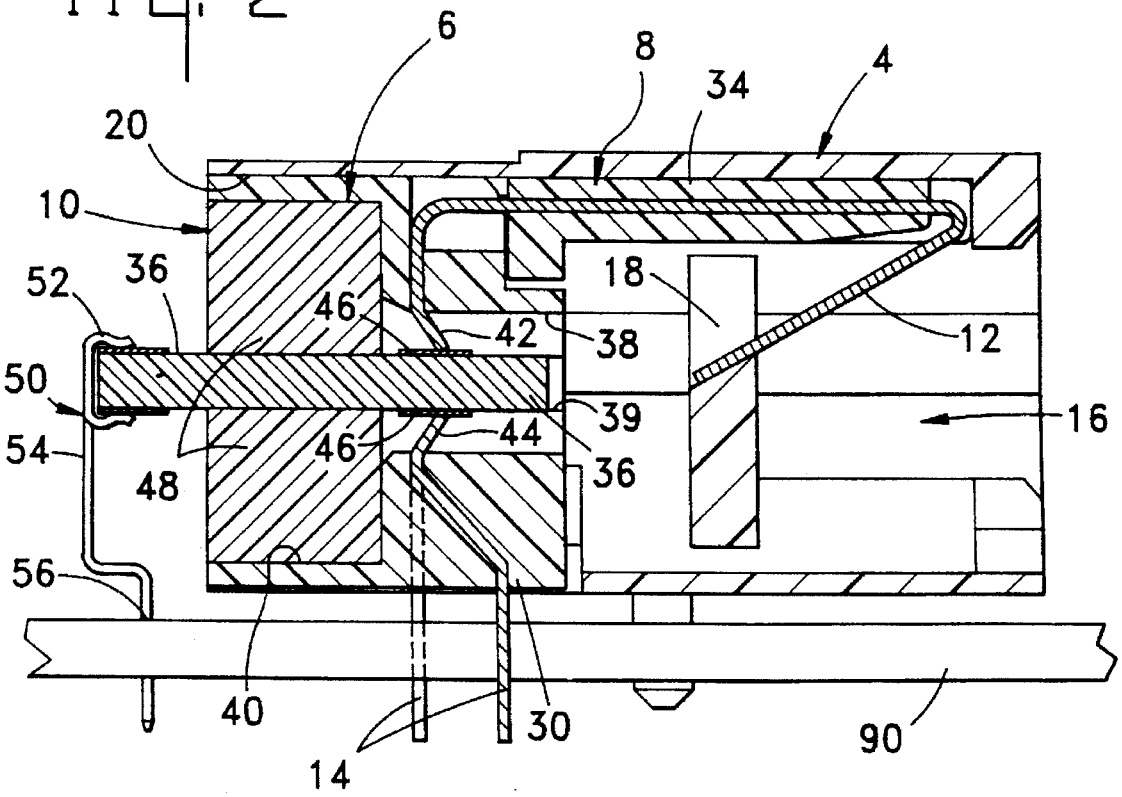
FIG. 2 is a sectional view of the embodiment of the modular jack connector shown in FIG. 1 showing the signal conditioning insert member including signal conditioning components encapsulated in a block.
Figure 9:
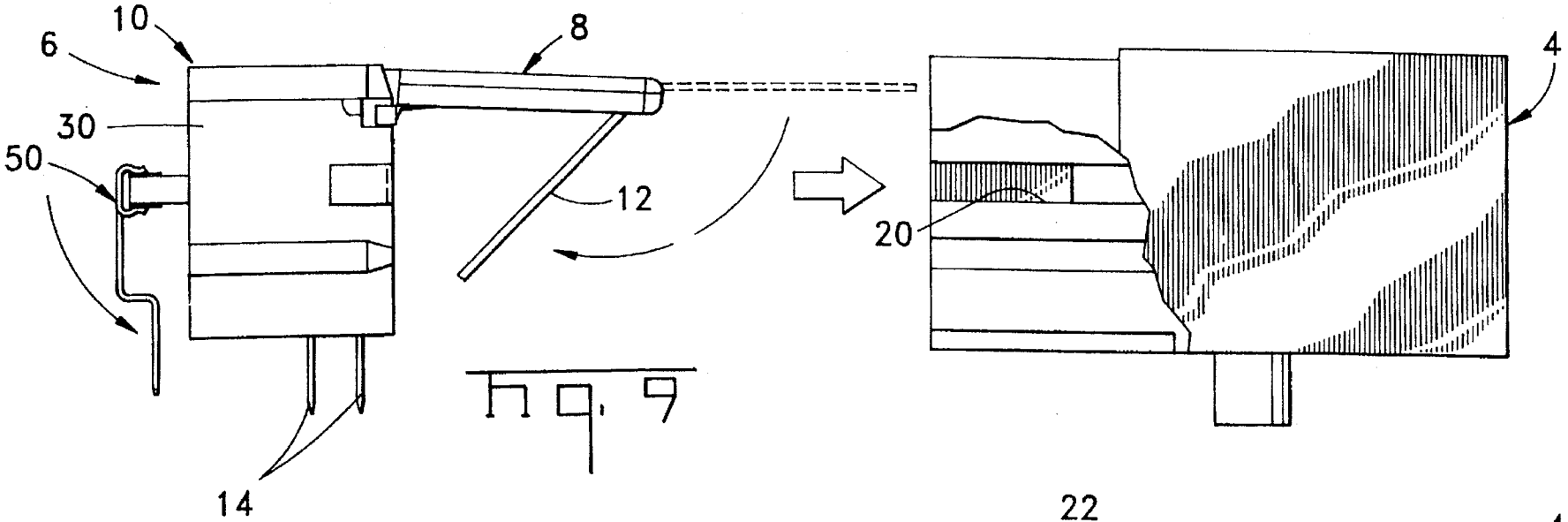
FIGS. 9 and 10 are views showing the manner in which the insert subassembly of the first embodiment is mounted in a modular jack housing.

The insert subassembly 6 can be positioned in the housing 4 by partially inserting the insert subassembly 6 into the rear of the housing 4. As shown in FIG. 9, the housing has an open ended channel 20 located at the rear end opposite from the plug mating cavity 16. This rear channel 20 is open at the back and along the bottom of the housing. The channel 20 communicates with the front plug mating cavity 16. As shown in FIG. 2, a comb 18, including a plurality of slots for separating the side by side contact terminals 12, is located between the rear channel 20 and the plug mating cavity 16.

Figure 10:
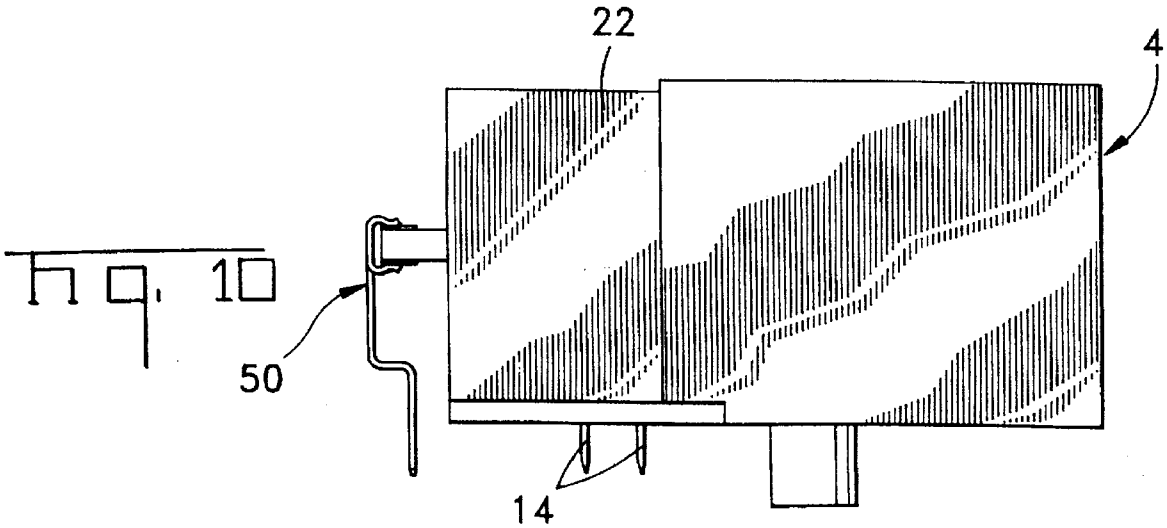

To position the insert subassembly 6 in the housing 4, the contact terminals 12 are bent downwardly to occupy a position, shown in FIG. 10, in which they will engage contacts on a modular plug positioned in the plug mating cavity 16. The portions of the contact terminals extending between the front insert member 8 and the rear insert member 10 are then bent substantially at right angles. The front insert member 8 is then inserted into the housing 4 and the individual contact terminals 12 extend into the slots formed in the comb 18. A groove extends from the rear channel 20 into the plug mating cavity 16. The front insert member 8 fits into this groove and this interfitting engagement keeps the contact terminals 12 in position. The rear insert member 10 is partially inserted into the open ended rear channel 20. Snap latches 32 on the exterior of the insert molded rear insert body 30 then engage housing latches in the housing rear channel 20 to hold the rear insert member in place. To this point the description of the fabrication and assembly of the modular jack 2, to the extent relevant to this invention, is substantially the same as the fabrication and assembly of the modular jack depicted in U.S. Pat. No. 5,362,257.

The modular jack assembly of the preferred embodiments of this invention differ from that depicted in U.S. Pat. No. 5,362,257 because active signal conditioning circuitry is included in this assembly. The signal conditioning circuitry employed with this invention can include a wide variety of components which are encapsulated on the printed circuit board 36. These signal conditioning components are encapsulated by potting the components with epoxy or by mounting the components in a separate enclosure mounted on the printed circuit board or by covering the components with a conformal coating. These components can be encapsulated prior to inserting the component printed circuit board into the rear channel of the modular jack housing or a potting material may be injected after insertion of the component printed circuit board subassembly into the rear channel. The signal conditioning components and the printed circuit board could also be placed in a mold and plastic could be insert molded around the signal conditioning components. These encapsulated components are shown in the form of a block 48 in the representative embodiments depicted herein. These signal conditioning components can include choke coils, transformers and LC filter as well as other signal conditioning components such as capacitors, ferrite beads and transient suppression diodes. This list of signal conditioning components is not intended to be all inclusive. The signal conditioning circuitry for which this invention is to be used is also not limited to circuitry which can be used to remove noise, although that is one significant application of this invention.

In each representative embodiment of this invention, one or more signal conditioning components are connected between corresponding contact terminals 12 and leads 14 or between corresponding pairs of contact terminals and leads. In many applications, multiple components are used. Three significant configurations should be enumerated. The first configuration is a choke only configuration in which a choke is connected between associated pairs of conductors. Additional signal conditioning can be achieved with a second configuration in which transformers are added. In a third configuration, LC filter circuits are added to form a choke-transformer-filter circuit. The signal conditioning components are mounted on a signal conditioning printed circuit board 36 encapsulated as previously described.

Figure 4:
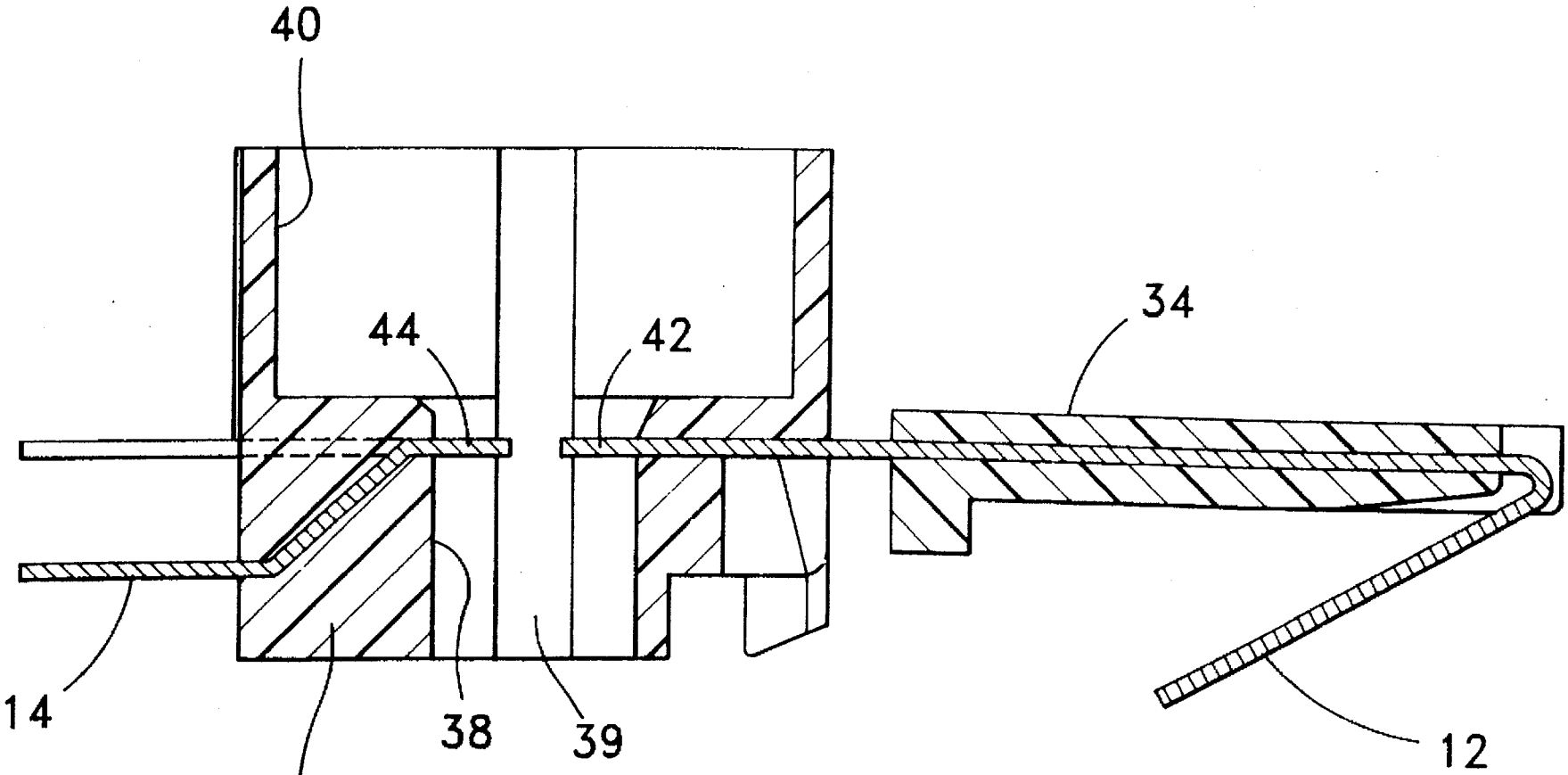
FIG. 4 is a sectional view of the body of the rear insert member in which the component printed circuit board is to be mounted.

FIGS. 3 and 4 show the two components of the rear insert 10 common to each of the six representative embodiments depicted herein. In addition to the encapsulated block 48 of signal conditioning components, or the conformal coating 108 covering and protecting the components, the component printed circuit board subassembly has a plurality of traces and terminal pads 46 which are located on both sides of the printed circuit board 36. Side by side pads 46 are shown adjacent the front edge on one surface of the printed circuit board 36. A single pad is shown adjacent to the rear edge of the printed circuit board in FIG. 3. In addition to connecting contact terminals and leads to signal conditioning components, traces on opposite sides of the printed circuit board, corresponding to specific pairs can crossover to improve the cross talk performance of the connector assembly.

This printed circuit board subassembly can be inserted into the rear insert body 30. As shown in FIGS. 3 and 4, the rear insert body has two communicating slot sections. The front slot section 38 is adjacent the front of the rear insert body 30 (at the bottom as viewed in FIGS. 3 and 4). This front slot section 38 communicates with a rear slot section 40. The width of the rear slot section 40 is greater than the width of the front slot section 38. Grooves 39 extend through both slot sections 38 and 40. The contact terminals 12 and the leads 14 are insert molded in the rear insert body 30 and contact terminal ends 42 and lead ends 44 extend into the front slot 38. The preferred method of fabricating these contact terminal ends 42 and lead ends 44 is to insert mold continuous stamped and formed terminals in the insert molded body 30. Initially these terminals extend continuously through the front slot section 38. A punch is then used to sever the initially continuous terminals to define contact terminal ends 42 and lead ends 44. As shown in FIG. 4, the ends 42 and 44 are spaced apart by a distance less than the width of the grooves 39 and protrude into the slot 38 past the edges of the grooves 39. As shown in FIG. 3, the printed circuit board 36 is inserted into the grooves 39 and into the communicating slot sections 38 and 40. The contact terminal ends 42 and the lead ends 44 will then engage corresponding terminal pads 46 upon insertion of the component printed circuit board subassembly into the slots in the rear insert body 30.

The first embodiment of this invention is shown in FIGS. 1 and 2. In each embodiment, the component printed circuit board is connected to the external printed circuit board 90 by leads 14 positioned in a standard modular jack footprint. For example, each embodiment could employ eight leads in a conventional offset and staggered footprint. FIG. 2 shows the completed insertion of the component printed circuit board subassembly into the aligned slots 38 and 40. The width of the rear slot section 40 is sufficient for insertion of component blocks 48 located on both sides of the printed circuit board. Contact is established by the terminal ends 42 and 44 with the circuit board pads 46. The contact terminal ends 42 and the lead ends 44 are deflected because the spacing between the ends 42 and 44 is initially less than the thickness of the printed circuit board, including the pads 46 on each side. A resilient contact is thus maintained. This interconnection is common to each of the embodiments depicted herein.

Each of the six representative embodiments includes at least one additional lead joining one or more traces or pads on the component printed circuit board 36 to circuits on the external printed circuit board 90. The first embodiment shown in FIGS. 1 and 2 employs an additional lead 50 which connects a ground plane on the component printed circuit board 36 with a ground plane on the external printed circuit board 90. This external lead 50 includes a resilient clip section 52 which can be inserted on the edge of the component printed circuit board 36 to establish contact with a ground pad on the top of the component printed circuit board 36. Clip section 52 engages the top and bottom of the printed circuit board with the upper section of clip 52 engaging a ground pad or a portion of the ground plane on the top of the component printed circuit board 36. The external lead 50 also includes a shank 54 extending between the resilient clip section 52 and a through hole lead section 56 at the lower end of the lead 50. As shown in FIGS. 1 and 2, the shank 54 is bent at right angles so that the through hole section 56 can be positioned closer to the other leads 14. Although this right angle bend serves to reduce the amount of printed circuit board real estate on the external board, it should be understood that some applications will not require this right angle bend. It should also be understood that the external lead 50 can be first connected to either the component printed circuit board 36 or to the external printed circuit board 90. For example, the clip 52 can be positioned in engagement with the component printed circuit board 36 and this additional lead can be soldered to the external printed circuit board 90 at the same time that the leads 14 in the standard footprint are soldered to the external board 90. Alternatively, the external lead 50 can be first soldered to the external printed circuit board and subsequently clipped to the component printed circuit board 36 at the time the modular jack assembly is mounted on the external printed circuit board.

FIGS. 9 and 10 show that the rear insert member 10 has been formed at right angles relative to the front insert member 8 prior to mating the insert subassembly 6 with the modular jack insulative housing 4. The contact terminal segments 12 which extend between the front insert member 8 and the rear insert member 10 have all been bent at right angles to form the insert subassembly 6 into this configuration. In this configuration, the rear insert subassembly 6 can be mated with the housing 4 by partially inserting the insert subassembly 6 into the open ended rear channel 20. Since the depth of the rear insert member 10 is a function of the size, shape and number of signal conditioning components used for the specific application of this invention, the rear of the housing must be open ended and the rear insert member will not necessarily be encased in the housing 4.

Figure 5:
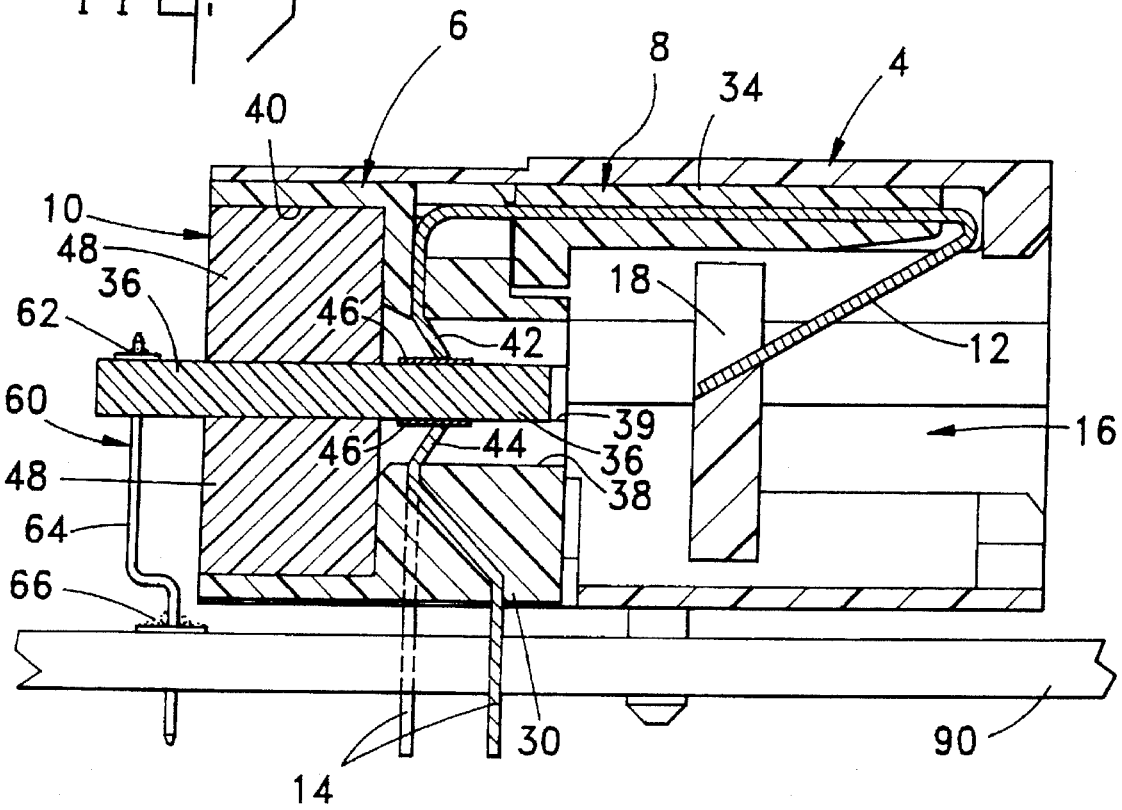
FIG. 5 is a view, similar to FIG. 2, of a second embodiment of this invention showing one through hole lead extending between the two printed circuit boards.

The second embodiment shown in FIG. 5 uses a lead 60 in the form of a pin having a shank 64 joining two through hole sections 62 and 66 suitable for insertion through a plated through hole in each printed circuit board. In this embodiment, the lead 60 also has a bent shank portion although the bend is not essential. A conventional solder connection is made on each printed circuit board, and as with the first embodiment, either connection can be made first. The internal configuration of the rear insert member 10 in FIG. 2, including the signal conditioning component blocks 48, the slots 38, 40 and the terminal ends 42, 44 is the second and the other representative embodiments is substantially the same as in the first embodiment of FIG. 2 and will not be repeated.

Figure 6:
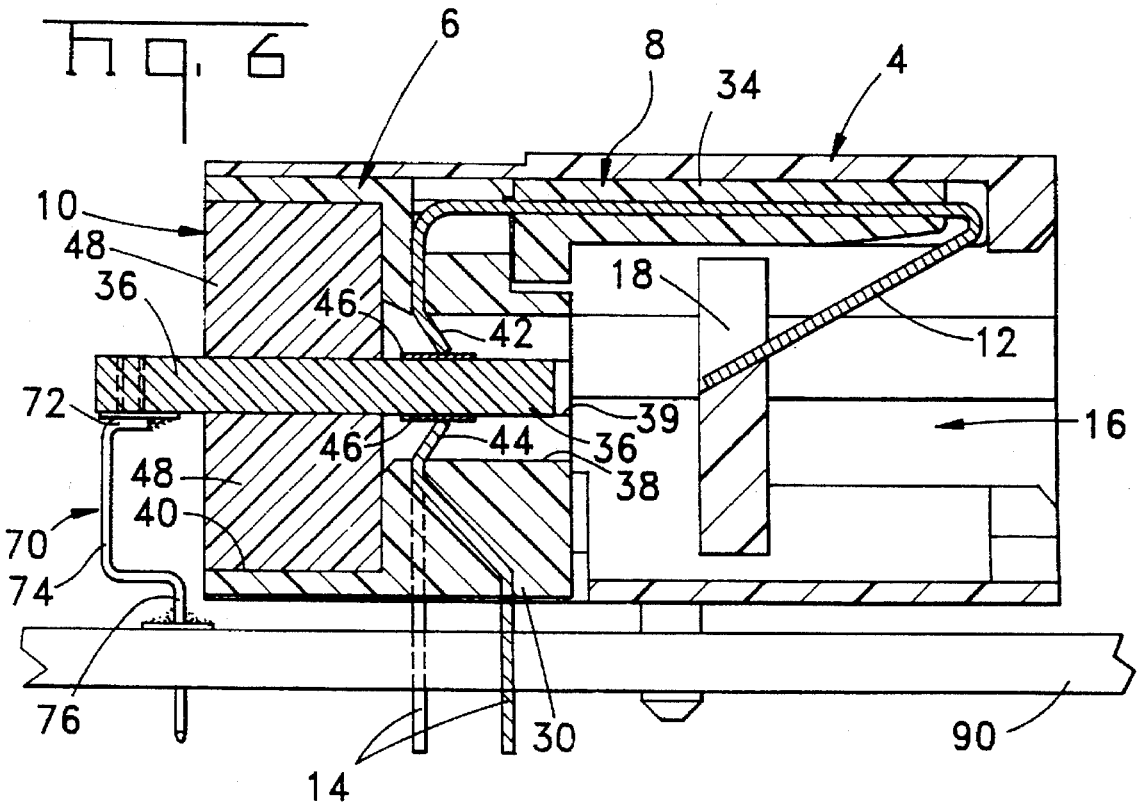
FIG. 6 is a view, similar to FIGS. 2 and 5, showing a third embodiment of this invention in which a surface mount lead is used.
Figure 7:
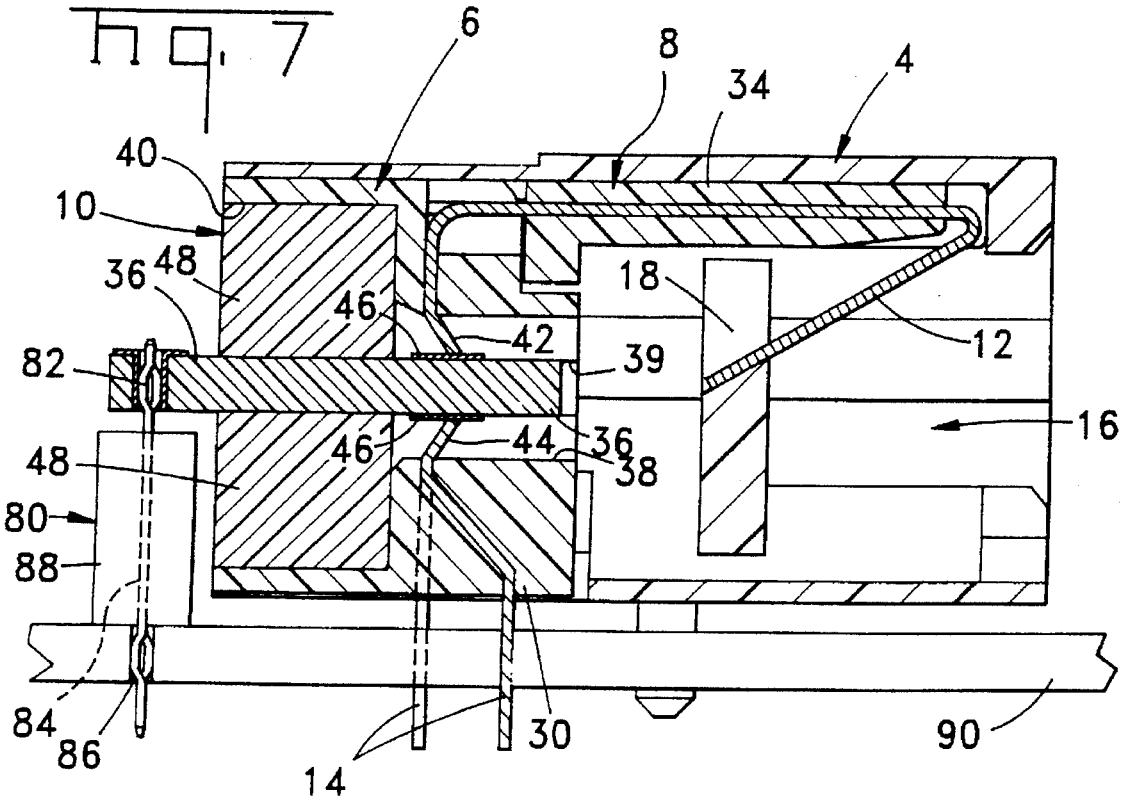

The third embodiment shown in FIG. 6 has an external lead 70 with a surface mount section 72 at one end. This surface mount lead section 72 is positioned to engage a surface mount solder pad on the lower surface of the component printed circuit board 36. A through hole via extends between the surface mount pad on the lower surface of this board to a ground surface located on the top of the component printed circuit board 36. In this embodiment, the lead 70 has a straight shank 74 joining the surface mount lead section 72 and the through hole lead section 76 at the opposite end of the lead. Of course, this embodiment could also employ a lead with a bent shank section. The external lead could also be attached to the external printed circuit board 90 by a surface mount solder joint.

Figure 7:
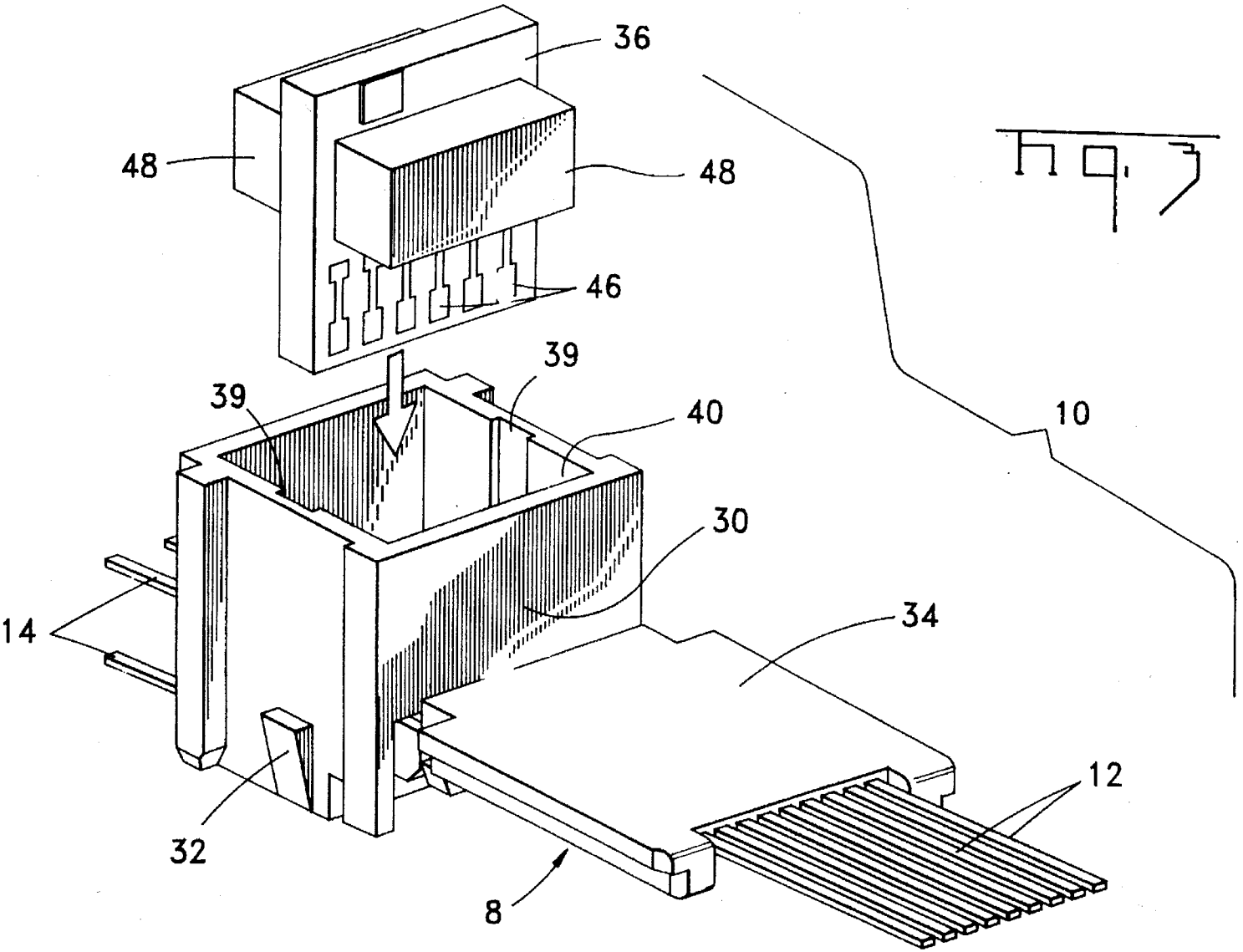
FIG. 7 is a view, similar to FIGS. 2, 5, and 6, showing a fourth embodiment of this invention in which compliant pins, mounted in a separate electrical connector are used to interconnect traces on the two printed circuit boards.

The fourth representative embodiment is shown in FIG. 7. In this embodiment, the external lead 80 has compliant pin sections 82 and 86 located at opposite ends of the shank 84. These compliant pin sections are of the type which have offset sections which engage the walls of a plated through hole in a printed circuit board to establish a solderless resilient connection when inserted into the printed circuit board. These compliant pin sections can be of conventional construction. The preferred compliant pin section is that used on ACTION PIN terminals manufactured and sold by AMP Incorporated. ACTION PIN is a trademark of The Whitaker Corporation. In this embodiment, one external lead 80 is shown. That lead 80 is located in an insulative housing 88 with the compliant pin sections 82 and 86 exposed at both ends. This connector configuration is especially useful when more than one external lead is to be used. The single external lead configurations discussed to this point are normally used to establish a ground path between the two printed circuit boards. However, some applications may require additional connections between the components on the component printed circuit board 36 in the modular jack insert member and other circuits on the external printed circuit board 90. By positioning the multiple leads in a connector housing, such as housing 88, the multiple leads can be attached to the printed circuit boards together. For the compliant pin versions, a resilient contact can be established by mounting the external connector on the printed circuit boards. It should be understood, that the multiple lead configuration is not limited to use of a compliant pin lead. Each of the other lead configurations, as well as other conventional leads or board to board terminals, could be used in this multiposition housing configuration.

Figure 8:
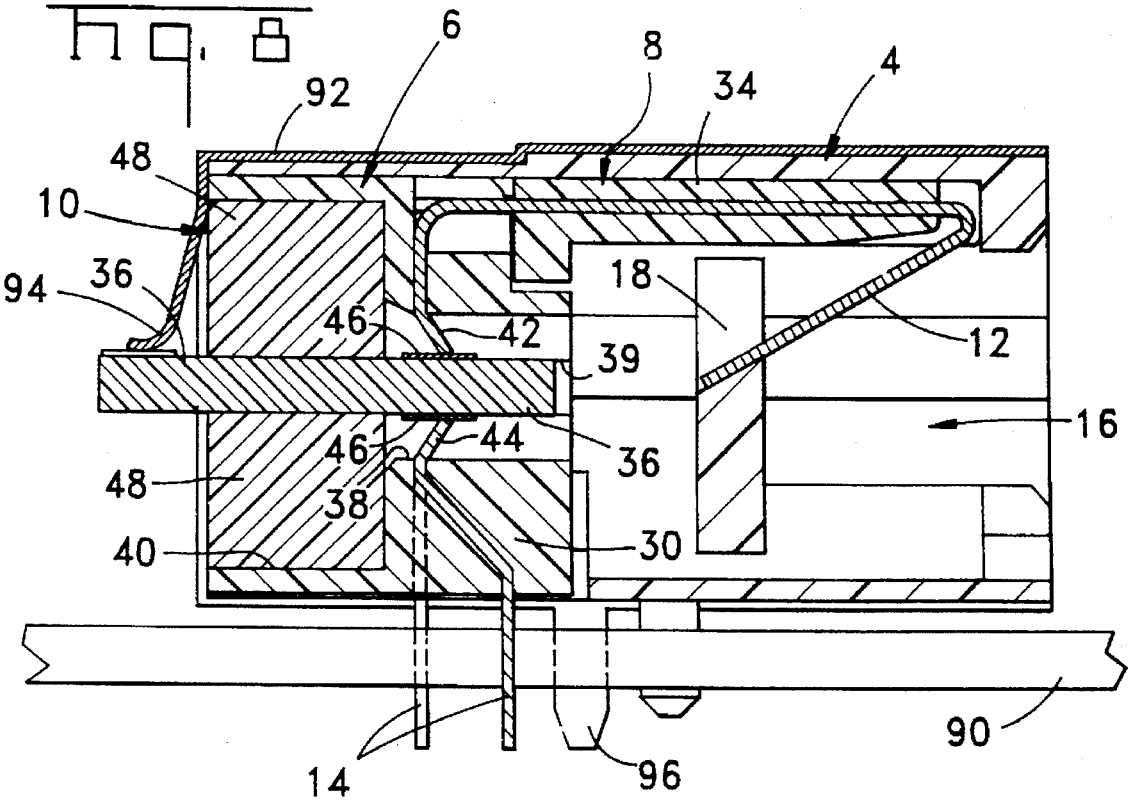
FIG. 8 is a view similar to FIGS. 2, 5, 6 and 7 showing a fifth embodiment of this invention in which the modular jack is shielded.

The fifth embodiment of this invention, shown in FIG. 8 is a shielded modular jack assembly. A shield 92 encloses the housing 4. The shield includes a tab 94 which is bent outwardly from the shield and engages the ground pad and the rear edge of the component printed circuit board 36. This tab 94 can be resilient and can establish a spring contact with ground pad or it can be soldered, welded or attached to the ground pad using any conventional method of attaching external conductive members to printed circuit board pads. The shield 92 also has one or more mounting legs 96 which are soldered to the main printed circuit board 90 in a conventional manner. A continuous ground connection is thus established between the two printed circuit boards.

Figure 11:
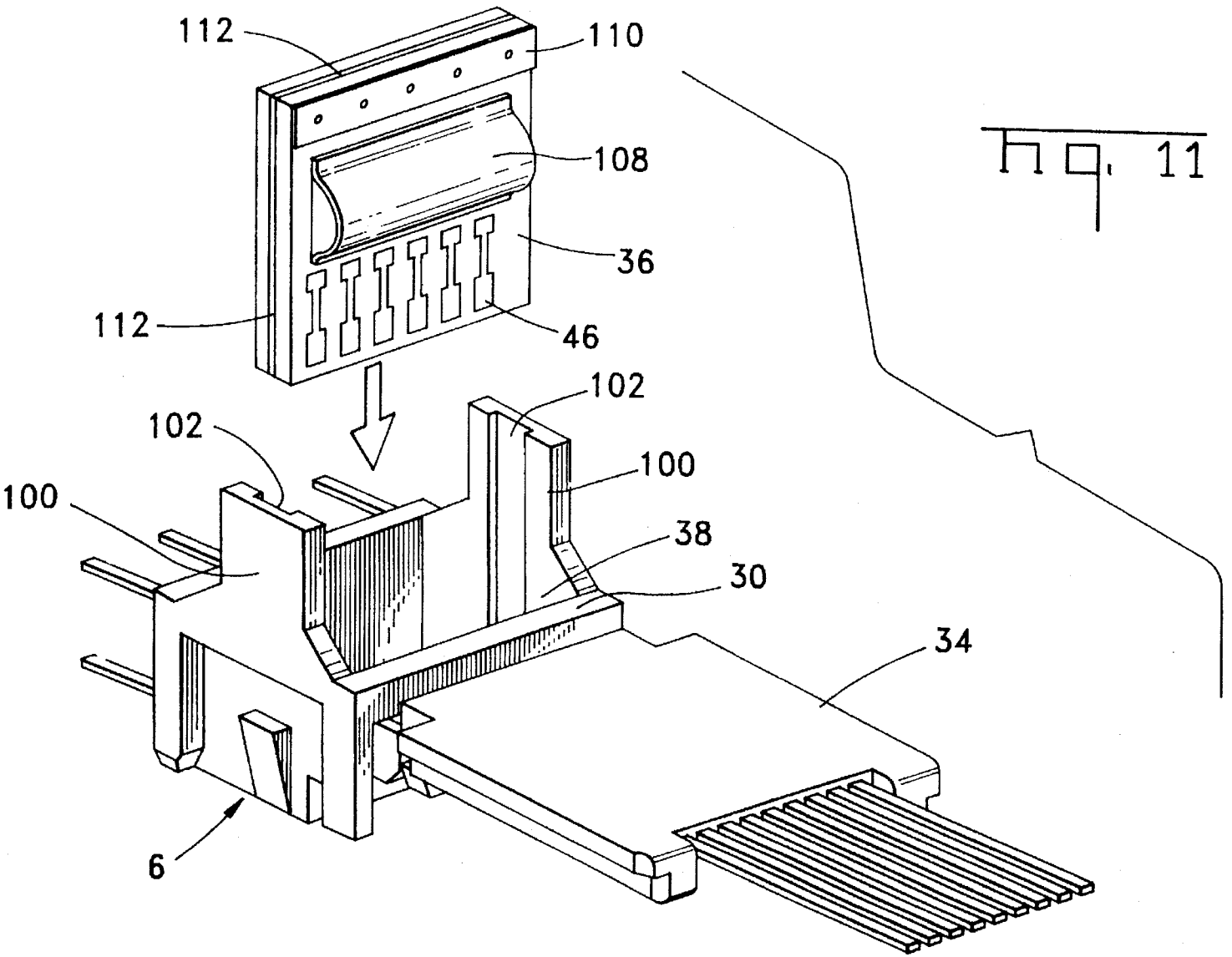
FIG. 11 is a view, similar to FIG. 3, showing a sixth embodiment.
Figure 12:
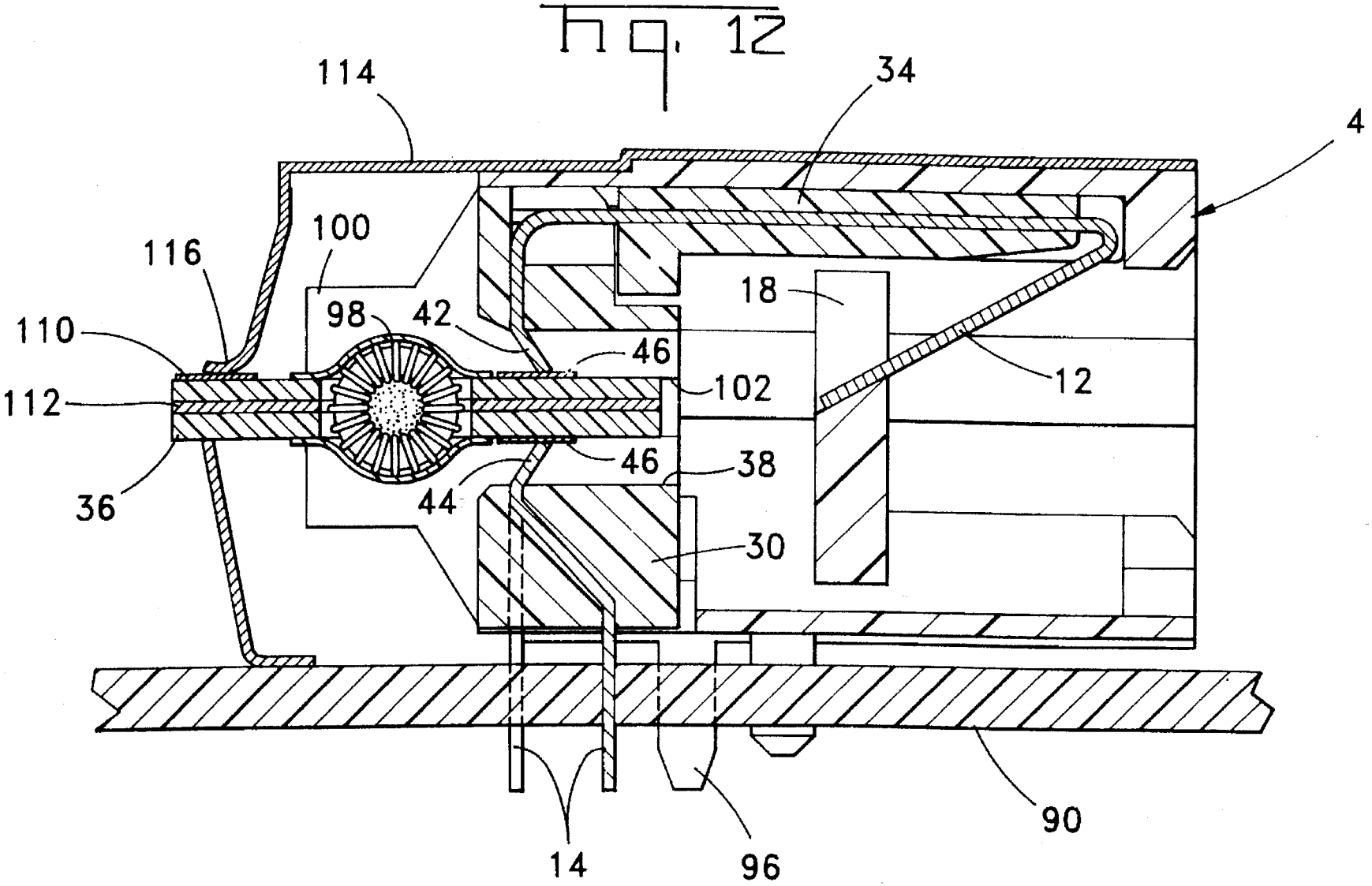
FIG. 12 is a view, similar to FIGS. 2, 5, 6, 7 and 8 showing a sixth embodiment.
Figure 17:
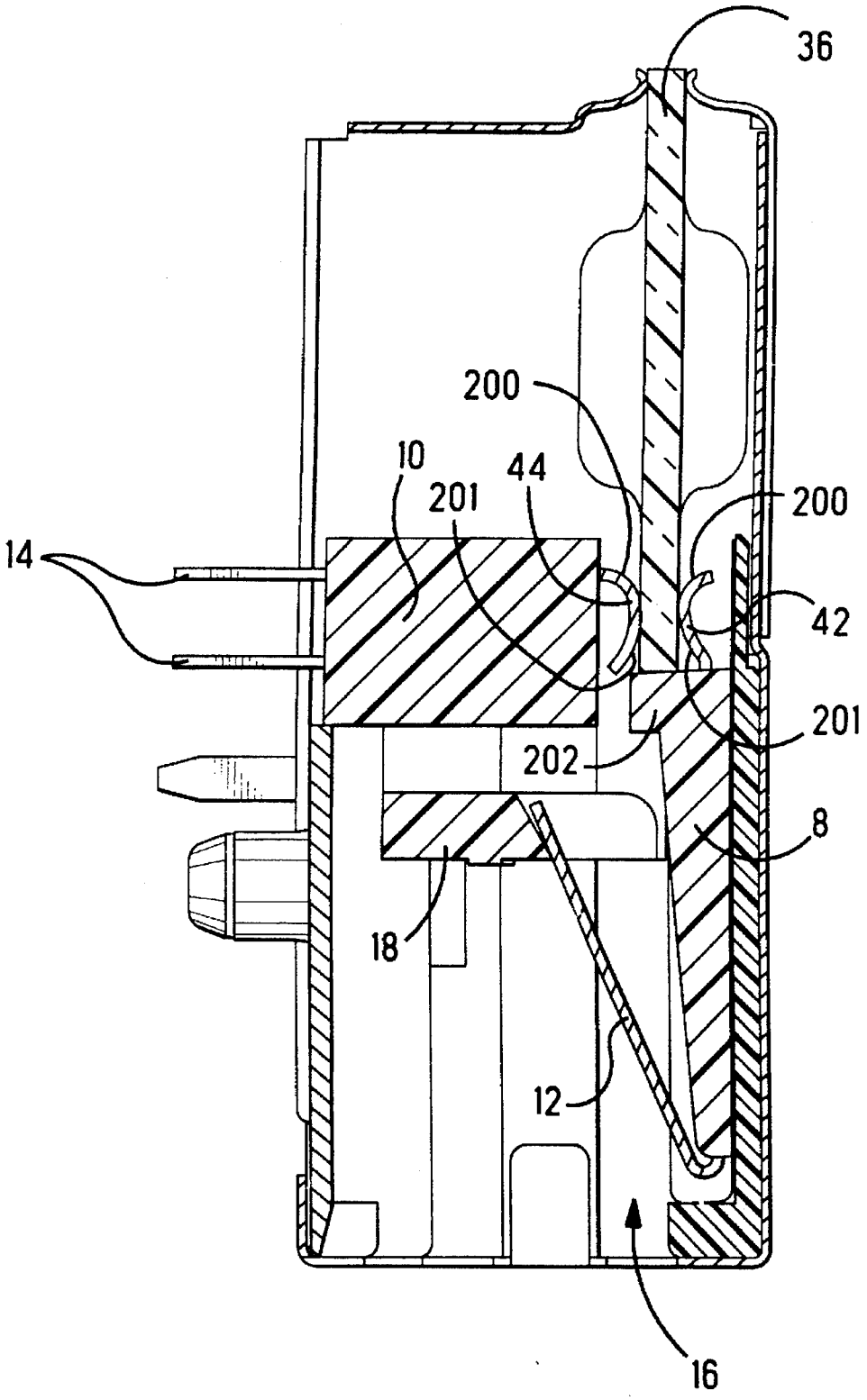

A sixth embodiment is shown in FIGS. 11 and 12. This embodiment is similar to the one shown in FIG. 8 in that the assembly is a shielded modular jack assembly. FIG. 11 shows the insert subassembly 6 where the rear insert member 10 is formed in a similar manner as described earlier. The rear insert body 30 has a front slot section 38. Rather than have a rear slot section, the rear insert body 30 has arms 100 which extend rearwardly from the front slot section 38. Grooves 102 extend along the arms 100 and into the front slot section 38 to guide a printed circuit board into proper position. The formation of the insert subassembly and the use in conjunction with the housing 4 is the same as was described earlier.

The printed circuit board 36 to be received in the rear of the insert subassembly has traces and terminal pads 46 therealong to engage the contact terminal ends 42 and the lead ends 44. The circuit board 36 has signal conditioning components therealong which are also connected to the traces 46 on the printed circuit board 36 in a similar manner as was described earlier. Rather than being secured in a block 48, the components are protected in a conformal coating 108. The conformal coating can be applied to protect the signal conditioning components and also the connections of the components to the traces 46. The printed circuit board 36 also has a ground pad 110 which extends along one length of the printed circuit board 36. The printed circuit board 36 also has a central ground plane 112 which extends all the way through the middle of the component printed circuit board 36. The ground plane 112 is electrically connected to the ground pad 110 by through hole vias. The ground plane 112 prevents crosstalk between traces and terminal pads 46, and between the contact ends 42 and the lead ends 44, on either side of the printed circuit board 36.

FIG. 12 shows the fully assembled modular jack assembly with the shield 114 which at least partially surrounds the housing 4. The shield 114 has a tab 116 along an opening through which the circuit board 36 extends. The tab 116 engages the ground pad 110 to provide a ground path from the printed circuit board 36, through the shield 114, and to the printed circuit board 90 by way of mounting leg 96.

FIG. 13 illustrates an alternate embodiment according to the teachings of the present invention wherein all parts are identical except for the front and rear insert members 8,10. In this embodiment, the front and rear insert members 8,10 have substantially the same shapes as described hereinabove, but they are manufactured as separate parts. The molded portion of the front insert member 8 is a substantially retangular volume having a wedge shaped interference member 202. The contact terminals 12 are molded into the front insert member 8 and extend therethrough. In this embodiment, the contact terminals 12 have a longer length extending out of the molded portion, the extra length being away from the plug mating cavity 16 end of the front insert member 8. The contact terminals 12 toward the plug mating cavity 16 end are bent back as in the previous embodiments. The terminals 12 engage the comb 18 and are positioned for mating with the modular plug in the plug mating cavity 16. The contact terminals 12 away from the plug mating cavity 16 end of the front insert member 8 are termed the contact terminal ends 42 and are bent to have a semicircular configuration. The semicircular configuration creates a forward lead-in 200 at a contact terminal end 42 distal from the molded portion of the front insert member 8 and a rearward lead-in 201. The rear insert member 10 comprises the leads 14 that extend therethrough to become lead ends 44. In this embodiment, the leads have a longer length, the length being apparent at the lead ends 44. The lead ends 44 are bent to form a semicircular configuration. The semicircular configuration of the lead ends 44 forms a forward lead-in 200 and a rearward lead-in 201 similar to the terminal contact ends 42. The front and rear insert members 8,10 are positioned relative to each other as taught in the previous embodiments. When the front and rear insert members 8,10 are so positioned, the contact terminals ends 42 and the lead ends 44 oppose each other. The component printed circuit board 36 is inserted inbetween the ends 42 and 44. The length of the ends 42 and 44 provide sufficient resilience to permit entry of the component printed circuit board 36. The material of the ends 42 and 44 is sufficiently stiff to assure reliable contact between the ends 42 and 44 and the terminal pads 46. Advantageously, the lead-ins 200 and 201 on the ends 42 and 44 of this embodiment provide for retraction and re-entry of the component printed circuit board 36 as needed for repair or upgrade. The wedge shaped interference member 202 provides a positive stop for the insertion of the component printed circuit board 36.

The embodiments depicted herein represent different examples of this invention intended primarily for network interface applications. This invention can however by used in other embodiments and for other applications, and the claims presented herein are not limited to the specific embodiments chosen as representative examples. In some cases, specific alternatives have been mentioned. For example, this invention could be used in top entry jacks, in jacks or connectors other than modular jacks, and for jacks which are not mounted on printed circuit boards. These specific alternatives are also intended to be representative and not exclusive.

We claim:

1. A modular jack electrical connector comprising:

a housing having a front face and a rear face with oppositely facing upper and lower surfaces between the front face and the rear face, a modular plug receiving cavity extending into the housing from the front face, the rear face having a rearwardly facing open ended channel, the channel communicating with the plug receiving cavity on the interior of the housing;

a plurality of contact terminals positioned in the modular plug receiving cavity to establish an electrical connection with a modular plug inserted into the cavity, the contact terminals also extending from the modular plug receiving cavity into the open ended channel;

a component printed circuit board, at least partially insertable into the open ended channel, the component printed circuit board having at least one signal conditioning component mounted thereon, the contact terminals being in electrical contact with the component printed circuit board and electrically connected to the signal conditioning components; and a plurality of leads, at least a portion of the leads being in electrical contact with the component printed circuit board and electrically connected to the signal conditioning components, and extending from the open ended channel for connection to external circuits.

2. The electrical connector of claim 1 wherein the component printed circuit board, the contact terminals and the leads are mounted in an insert member, the insert member being mounted in the open ended channel.

3. The electrical connector of claim 2 wherein the contact terminals and the leads are insert molded in the insert member.

4. The electrical connector of claim 2 wherein the insert member includes a slot in which the component printed circuit board is inserted.

5. The electrical connector of claim 4 wherein ends of the contact terminals and the leads extend into the slot.

6. The electrical connector of claim 5 wherein the slot is molded in the insert member.

7. The electrical connector of claim 6 wherein the ends of the contact terminals and the ends of the leads are formed by punching continuous members extending through the slot.

8. The electrical connector of claim 4 wherein the slot in the insert member includes two sections, the first slot section containing the ends of the contact terminals and the leads, the second slot section having a greater width than the first slot section with the components on the component printed circuit board being positioned in the second slot section.

9. The electrical connector of claim 8 wherein the first slot section is located between the second slot section and the plug receiving cavity.

10. The electrical connector of claim 1 wherein the components are encapsulated on the printed circuit board.

11. The electrical connector of claim 4, wherein arms extend from the slot, grooves extend from inside the slot and along the arms to guide the component printed circuit board.

12. The electrical connector of claim 1, wherein the component printed circuit board has two sides, first terminal pads are disposed along one side to engage the contact terminals, second terminal pads are disposed along the other side to engage the leads, a ground plane extends through the center of the component printed circuit board thereby shielding the first and second terminal pads from each other and shielding the plurality of contact terminals from the plurality of leads.

13. The electrical connector of claim 12, wherein the housing is at least partially surrounded by a shield having a tab and the component printed circuit board having a ground pad in electrical connection with the ground plane, the tab engaging the ground pad to provide a ground path from the component printed circuit board.

14. A modular jack electrical connector assembly comprising:

a housing having a front face and a rear face with oppositely facing upper and lower surfaces between the front face and the rear face, a modular plug receiving cavity extending into the housing from the front face, the rear face having a rearwardly facing open ended channel, the channel communicating with the plug receiving cavity on the interior of the housing;

a plurality of contact terminals positioned in the modular plug receiving cavity to establish an electrical connection with a modular plug inserted into the cavity, the contact terminals also extending from the modular plug receiving cavity into the open ended channel;

a component printed circuit board, at least partially insertable into the open ended channel, the component printed circuit board having at least one signal conditioning component mounted thereon, the contact terminals being in electrical contact with the signal conditioning printed circuit board and electrically connected to the signal conditioning components;

a plurality of first leads, at least a portion of the first leads being in electrical contact with the printed circuit board and electrically connected to the signal conditioning components, extending from the open ended channel for connection to external circuits;

an insert member surrounding the signal conditioning components and a portion of the component printed circuit board, the component printed circuit board extending beyond the insert member, and at least one second lead connected to the portion of the component printed circuit board extending beyond the insert molded body and extending therefrom for connection to an external circuit.

15. The modular jack assembly of claim 14 wherein the second lead comprises a ground lead connected to a ground reference on the component printed circuit board.

16. The modular jack assembly of claim 15 wherein a ground plane is located on the top of the component printed circuit board, the second lead engaging the ground plane.

17. The modular jack assembly of claim 14 wherein the second lead comprises a clip engaging the component printed circuit board, the clip forming a resilient solderless connection with the component printed circuit board.

18. The modular jack assembly of claim 17 wherein the clip engages opposite sides of the component printed circuit board.

19. The modular jack assembly of claim 14 wherein the component printed circuit board in the open ended channel is positioned parallel to the upper and lower surfaces of the housing.

20. The modular jack assembly of claim 14 further including a plurality of second leads.

21. The modular jack assembly of claim 14 wherein the insert molded body comprises a rear insert member and the contact terminals are insert molded in a separate member, the separate member comprising a front insert member insertable through the rearwardly facing open ended channel into the plug receiving cavity.

22. The modular jack assembly of claim 21 wherein portions of the contact terminals extend between the front and rear insert members and are bent at right angles between the front and rear insert members after the front and rear insert members are insert molded so that the front insert member can be inserted into the housing and the rear insert member can be mated with the housing in the rearwardly facing open ended channel.

23. The modular jack assembly of claim 14 wherein the second lead establishing a ground connection between the component printed circuit board and the external printed circuit board comprises a shield at least partially enclosing the modular jack housing.

24. A modular jack assembly as recited in claim 1 wherein the front insert member has a contact terminal end having forward and reverse lead-ins and the rear insert member has a lead end having forward and reverse lead-ins.

25. A modular jack assembly as recited in claim 24 wherein said front insert member further comprises an interference member.

* * * * *